United States Patent [19]

Theissen et al.

[11] Patent Number: 4,705,189

[45] Date of Patent: Nov. 10, 1987

[54] DOUBLE WALLED INSULATED CONTAINER FOR STORING LOW BOILING LIQUIFIED GASES

[75] Inventors: Friedel Theissen, Erkelenz; Heinrich Fieseler, Dormagen, both of Fed. Rep. of Germany

[73] Assignee: Messer Griesheim GmbH, Fed. Rep. of Germany

[21] Appl. No.: 874,385

[22] Filed: Jun. 16, 1986

[30] Foreign Application Priority Data

Jul. 17, 1985 [DE] Fed. Rep. of Germany ..... 3525464

[51] Int. Cl.[4] ..... B65D 25/02

[52] U.S. Cl. ..... 220/465; 220/446; 285/915

[58] Field of Search ..... 220/430, 446, 465, 431; 285/915

[56] References Cited

U.S. PATENT DOCUMENTS

| | | | |
|---|---|---|---|
| 4,022,500 | 5/1977 | van den Beld | 285/915 X |
| 4,120,421 | 10/1978 | Prost | 220/446 X |
| 4,394,929 | 7/1983 | Patel et al. | 220/465 X |
| 4,572,402 | 2/1986 | Gervais et al. | 220/465 |

*Primary Examiner*—Steven M. Pollard

*Attorney, Agent, or Firm*—Connolly & Hutz

[57] ABSTRACT

A double walled insulated container for storing low boiling liquified gases includes inner and outer containers with insulation therebetween. A tubular neck connects the openings of both containers. The joints between the neck tube and the respective containers is designed as conical seated joints whereby the container openings are shrink fitted onto the neck tube with adhesive applied to the conical surface.

3 Claims, 1 Drawing Figure

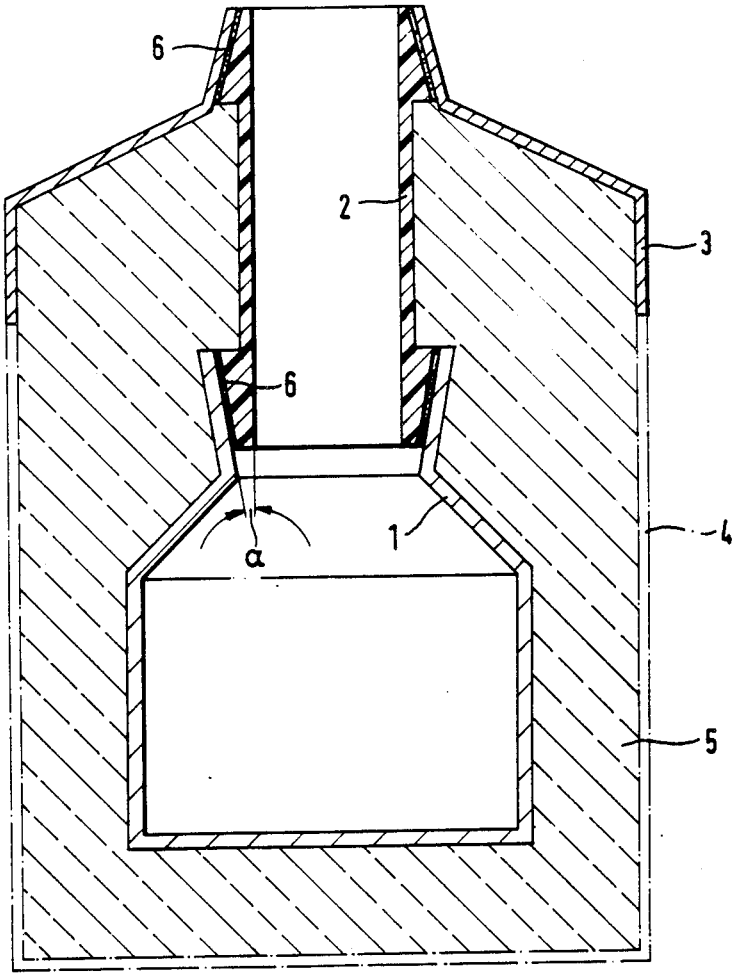
6
2
3
6
1
4
α
5

DOUBLE WALLED INSULATED CONTAINER FOR STORING LOW BOILING LIQUIFIED GASES

BACKGROUND OF THE INVENTION

The invention is concerned with a double walled insulated container for storing low boiling liquified gases with an inner container and an outer container of aluminum or steel as well as a neck tube, consisting of fiberglass reinforced plastic, for connecting the two containers.

Doubled walled insulated containers for low boiling liquified gases are increasingly made of aluminum since such containers are considerably lighter then those made of steel. Between the inner container and the outer container, there is a high grade insulation and, likewise, the joint between the inner container and the outer container, the so-called neck tube must have good thermal insulation.

For this purpose, neck tubes made of plastic, especially fiberglass reinforced epoxy resin, have performed well. High requirements are expected relating to the joint between the neck tube and the containers. This joint must be mechanically stable and completely gas tight.

Aside from this, this joint should not be too expensive. Known joints are designed as screw joints or crimp joints with which an adhesive can additionally be applied in order to achieve airtightness. Such a joint is disclosed, for example, by GB PS No. 1 125 588. A joint is known from EP-0S No. 0 098 766, according to which the neck tube is connected to the containers solely by adhesion. For this purpose, the containers' openings are cone shaped and, together with the cylindrical neck tube, form a gap which can be filled with adhesive. This joint cannot be satisfactory in all cases since precise glued joint requires that it be smooth, thin and even and it contains no gas or air inclusions. Aside from this, the glued joint should not be subjected to tension. In the case of known joints, such tensions cannot be avoided, at least during transport. Screw joint or crimp joints which are satisfactory as far as sealing and mechanical stability are concerned are fairly expensive to manufacture.

SUMMARY OF INVENTION

The objective of the invention is, in the case of double walled insulated containers of the above mentioned type, to achieve a joint between the fiberglass reinforced plastic neck tube the containers which are made of aluminum which, even though it is inexpensive to manufacture, has complete mechanical stability and absolute gas tightness.

The joint according to the invention permits very thin, smooth adhesive layers which are absolutely free of air and/or gas inclusions. This joint is, moreover, subjected to pressure and shear exclusively since it is designed as a cone shaped seat with which the opening of the container is shrink fitted by treating with heat. Because of the low thermal expansion of the fiberglass reinforced plastic, a compression between the aluminum and plastic surfaces is achieved when warming the parts to be joined, which permits waiving both the contact pressure and the clamping of the parts to be joined in a suitable device. The surface compression is, with prior heating of the parts to be joined, so great that the joint cannot be loosened again at room temperature even without the presence of adhesive. The compression force can be further increased by boosting the temperature or by heating the aluminum container alone.

During the actual manufacture, the parts to be joined are heated to 100° C. before the application of adhesive and subsequently connected with a slight twist. The hardening can occur in an oven or at room temperature depending upon the type of adhesive. The joints made in this manner, in accordance with the invention, were subjected to various temperature changes and aging tests. The samples withstood combined tests and showed an outstanding air/gas tightness.

THE DRAWING

The single FIGURE shows a cross-section of a simplified embodiment of the invention.

DETAILED DESCRIPTION

The double walled insulated container shown in the drawing consists of the inner container 1, the neck tube 2 the top of the outer container 3, the lower part of the outer container 4 and the insulation 5. The lower part of the outer container 4 is shown with broken lines since it is welded on only after the joint between the neck tube and each container according to the invention. The inner container 1, like the outer container, is made of aluminum and the neck tube 2 is made of fiberglass reinforced epoxy resin. The joints between the neck tube 2 and each of the containers are designed as conical seated joints according to the invention. For this purpose, the inner container 1 has a conically expanding opening and the top of the outer container 3 a conically contracting opening with an angle of inclination of 6°. This angle of inclination need not absolutely be the same for both containers but it should, in any case, be between 1° and 20°.

The neck tube 2 is made of a thick walled smooth tube which is tapered at the same angle of inclination as the container openings. All three parts can thus be fitted together. The neck tube is made with a minimal wall strength/gauge over its free length.

During the manufacture of the double walled insulated container, the inner container 1 or only its conically expanding opening is heated to about 100° C. Then, the inner side of the opening of the inner container 1 and a tapered end of the neck tube 2 are moistened with adhesive and fitted together with light pressure and slight twist. Because of thermal expansion, the conical opening of the inner container 1 has expanded so that, upon subsequent cooling, of the inner container 1, a surface pressure between the its conical opening and the tapered end of the neck tube 2 results. The surface pressure, together with the hardening adhesive, causes a vacuum tight joint between neck tube 2 and the inner container 1 to occur. The surfaces of the conical seated joint are thus pressed together at high pressure and the thin layer of adhesive 6 is impacted only by pressure and shear. Possible tension forces are taken up by the pressure forces of the pressurized seat. The joint according to the invention thereby represents an ideal condition for a glued joint.

After the glued joint cools and has hardened, the insulation 5 is applied onto the inner container 1. Then, the free end of the neck tube 2 and the top of the outer container 3 are joined. For this purpose, the top of the outer container 3, or only its conically contracting opening is heated to 100° C. Then, the adhesive is applied to the hot inner surface of the conically contracting opening of the top of the outer container 3 and to the conically tapered end of the neck tube 2. The two parts are then immediately plugged into one another with light pressure and a slight twist. As a result of cooling the top of the outer container 3 to room temperature, there results a force fit between the conically contracting opening of the top of the outer container 3 and the conically tapered end of the neck tube 2. This force fit, together with the adhesive 6, provides a vacuum tight joint.

Finally, the lower part of the outer container 4 is slid over the insulation 5 and is welded or glued to the top of the outer container 3.

The manufacturing process described above requires no clamping devices nor centering devices. Because of the low thermal expansion coefficient of the fiberglass reinforced epoxy resin from which the neck tube is made, it is otherwise assured that, in the temperature range of 100° C. down to operation temperature, a steady surface compression between the neck tube 2 and the opening of the inner and/or outer containers occurs. The layer of adhesive 6 is therefore not affected by tension in any event.

The preferred realm of application for the invention is with double walled insulated containers made of aluminum and with which the neck tube consists of fiberglass reinforced plastic, especially epoxy resin. In special cases, the invention can also be used with containers of steel, especially stainless steel. The neck tube can, in special cases, be made of plastic without reinforcing inserts.

What is claimed is:

1. In a double walled insulated container for storing low boiling liquified gases with an inner container made of a metal selected from the group consisting of aluminum and steel, an outer container with insulation between the two containers, a neck tube made of plastic for connecting the openings of the two containers as well as glued joints between the neck tube the respective container openings, the improvement being in that each of said joints between said neck tube and the respective container openings being in the form of conical seated joint connected to said neck tube and having an angle of inclination between 1° and 20° whereby the respective container openings are shrink fitted onto said neck tube and a thin adhesive is applied to the conical surface of said joint, and each of said joints extending outwardly from said neck tube and having a maximum diameter greater than the diameter of said neck tube.

2. Double walled container according to claim 1, characterized therein that the angle of inclination of the conical seat is 6°.

3. Double walled container according to claim 1, characterized therein that said neck tube includes an integral conical joint at its upper end tapering outwardly and downwardly in contact with said opening of said outer container and an integral conical joint at its lower end tapering outwardly and upwardly in contact with said opening of said inner container.

* * * * *